US011466603B2

(12) United States Patent
Martin

(10) Patent No.: US 11,466,603 B2
(45) Date of Patent: Oct. 11, 2022

(54) FAUX IGNITION COIL CRANKCASE BREATHER

(71) Applicant: Lokar, Inc., Knoxville, TN (US)

(72) Inventor: Elio Martin, Litchfield, OH (US)

( * ) Notice: Subject to any disclaimer, the term of this patent is extended or adjusted under 35 U.S.C. 154(b) by 0 days.

(21) Appl. No.: 17/335,200

(22) Filed: Jun. 1, 2021

(65) Prior Publication Data

US 2022/0010706 A1 Jan. 13, 2022

Related U.S. Application Data

(60) Provisional application No. 63/032,165, filed on May 29, 2020.

(51) Int. Cl.
*F01M 13/04* (2006.01)
*F01M 13/00* (2006.01)

(52) U.S. Cl.
CPC ..... *F01M 13/04* (2013.01); *F01M 13/0011* (2013.01)

(58) Field of Classification Search
USPC ..... 123/572–574
See application file for complete search history.

(56) References Cited

U.S. PATENT DOCUMENTS 2,327,784 A * 8/1943 Hartzell ..... H01F 38/12 336/92
2,330,116 A * 9/1943 Evans ..... B01D 35/005 210/167.02
3,241,537 A * 3/1966 Jones ..... F01M 13/04 123/572
4,105,007 A * 8/1978 Mochimaru ..... H04B 15/025 123/634
5,234,589 A * 8/1993 Sussich ..... B01D 36/04 210/306
5,586,996 A * 12/1996 Manookian, Jr. ..... F01M 13/04 55/321
5,912,368 A * 6/1999 Satarino ..... B01D 45/08 55/320
6,328,442 B1 * 12/2001 Brinkly ..... B41J 29/10 347/104
6,729,316 B1 * 5/2004 Knowles ..... F02M 35/10222 123/572
7,334,574 B1 * 2/2008 Roulliard ..... F02M 25/06 123/572

(Continued)

FOREIGN PATENT DOCUMENTS

CN 108757116 A * 11/2018
CN 209925066 U * 1/2020

(Continued)

*Primary Examiner* — George C Jin
*Assistant Examiner* — Teuta B Holbrook
(74) *Attorney, Agent, or Firm* — Blanchard Horton PLLC

(57) ABSTRACT

A crankcase breather configured to simulate an ignition system coil is provided that comprises a substantially cylindrical canister having a hollow interior, a first aperture provided proximate a top of the canister and a second aperture provided proximate a bottom of the canister, at least one of the first and second apertures opening to the interior and configured to be connected to a breather hose, and one or more output apertures formed in the canister to release gases received through the breather hose. An exterior of the canister is shaped to resemble an ignition system coil.

6 Claims, 4 Drawing Sheets

(56) References Cited

U.S. PATENT DOCUMENTS

| | | | | |
|---|---|---|---|---|
| 8,201,544 | B2 * | 6/2012 | Cattani | F02M 25/06 123/572 |
| 9,260,993 | B1 * | 2/2016 | Mainiero | B01D 45/06 |
| 10,619,536 | B2 * | 4/2020 | Lewis | F01M 13/04 |
| 10,890,089 | B2 * | 1/2021 | Lewis | F01M 13/04 |
| 2005/0132997 | A1 * | 6/2005 | Vargas | F02F 7/006 123/195 C |
| 2006/0196821 | A1 * | 9/2006 | Selsdon | B01D 17/0202 210/446 |
| 2013/0118357 | A1 * | 5/2013 | Meusel | F01L 1/047 96/217 |
| 2014/0034031 | A1 * | 2/2014 | Wagner | F01M 13/023 123/574 |
| 2014/0208703 | A1 * | 7/2014 | Willems | B01D 46/0031 55/423 |
| 2014/0331669 | A1 * | 11/2014 | Jones | F02M 26/19 60/605.2 |
| 2016/0082378 | A1 * | 3/2016 | Ishida | B01D 45/14 55/403 |
| 2017/0002704 | A1 * | 1/2017 | Takada | F01M 13/0011 |
| 2017/0022931 | A1 * | 1/2017 | Webb | F02F 7/0068 |
| 2017/0128867 | A1 * | 5/2017 | Vining | B01D 45/04 |
| 2018/0274657 | A1 * | 9/2018 | Trimmer | B01D 35/306 |

FOREIGN PATENT DOCUMENTS

| | | | | |
|---|---|---|---|---|
| CN | 210948846 | U * | 7/2020 | |
| CN | 211737325 | U * | 10/2020 | |
| EP | 1030037 | A1 * | 8/2000 | F01M 13/022 |
| WO | WO-9850128 | A1 * | 11/1998 | B01D 27/02 |

* cited by examiner

FAUX IGNITION COIL CRANKCASE BREATHER

CROSS-REFERENCE TO RELATED APPLICATIONS

This application claims priority to U.S. Provisional Patent Application Ser. No. 63/032,165, filed on May 29, 2021, the entirety of which is incorporated herein by reference.

FIELD OF INVENTION

The present general inventive concept relates to a vehicle engine crankcase breathers, and more particularly, to a crankcase breather constructed to resemble a vehicle ignition system coil.

BACKGROUND

As known in the automotive industry, over the last several decades fuel injection systems have replaced carburetors as the standard fuel system in internal combustion engines. These fuel injection systems have eliminated various components that were present in the carburetor-based systems, such as a centrally located ignition coil, distributor and distributor cap, etc.

Many automobile enthusiasts, such as antique vehicle restorers, automobile customizers, and "hot rod" builders and drivers, value the aesthetic appearance and nostalgia of vehicle engines featuring older type fuel systems that include the above-discussed ignition coils, distributors, distributor caps, etc., found in carburetor-based fuel systems. For enthusiasts with vehicles featuring modern fuel injection systems, these enthusiasts may desire to incorporate into the modern fuel injection system one or more simulated components to recreate the appearance of more traditional components associated with carburetor-based fuel systems. It would be desirable to provide such simulated components for aesthetic purposes. It would also be desirable for such simulated components to perform a beneficial function along with their aesthetic appearance.

In the operation of internal combustion engines of the type used in the automotive industry, so-called "blow by" occurs when combustion material from the combustion chamber "blows" past the piston rings and into the crankcase. These blow-by gases, if not ventilated, inevitably condense and combine with the oil vapor present in the crankcase, forming sludge or causing the oil to become diluted with unburnt fuel. Excessive crankcase pressure can furthermore lead to engine oil leaks past the crankshaft seals and other engine seals and gaskets. Therefore, in modern automotive internal combustion engine designs, a crankcase ventilation system is often used. A crankcase ventilation system allows for the venting of unwanted gases from the crankcase of an internal combustion engine. The system typically consists of a tube, often referred to as a "breather hose", leading from an internal chamber of the crankcase to allow air within the crankcase to vent outward. More sophisticated crankcase ventilation systems may also include a one-way valve and a vacuum source, such as the intake manifold, to establish and maintain negative pressure within the crankcase.

In order to avoid venting oil vapor and fuel waste present in the crankcase gasses to the atmosphere, modern designs of crankcase ventilation systems often route the breather hose from the crankcase to a device which is often referred to as a "breather" or "catch can". The breather typically consists of a canister which allows air to pass therethrough, and which is configured to "catch" any oil or fuel droplets emitted from the crankcase, before allowing the crankcase gasses to leave the canister. In the case of crankcase ventilation systems that maintain neutral air pressure inside the crankcase, the breather may allow the gasses from the crankcase to vent to the atmosphere, and may also allow atmospheric gasses to reenter the crankcase via the breather and breather tube. In the case of crankcase ventilation systems that maintain negative air pressure inside the crankcase, crankcase gasses leaving the breather may be routed to the air intake of the engine. Such "negative pressure" crankcase breathers may often, though not always, be provided with baffles, filters, or the like to prevent oil mist and vapor from being introduced to the air intake of the engine, thereby fouling the engine's air filter.

In view of the above, it is desirable to provide a crankcase breather for use in an internal combustion engine which may also be used to provide the aesthetics of an ignition coil, of the type found in a carburetor-based older type fuel system.

BRIEF SUMMARY

The foregoing and/or other aspects and advantages of the present general inventive concept may be achieved by providing a crankcase breather configured to simulate an ignition system coil including a canister portion, an intake aperture provided proximate a top of the canister portion, the intake aperture configured to be connected to a breather hose, and one or more output apertures formed in the canister to release gases received through the breather hose.

According to various example embodiments of the present general inventive concept, a device is provided to function as a crankcase breather and catch can while presenting the look of an ignition coil of a distributor ignition system. Various aspects of the present general inventive concept may be achieved by providing a crankcase breather configured to simulate an ignition system coil, the crankcase breather including a substantially cylindrical canister having a hollow interior and defining a first aperture provided proximate a top of the canister and a second aperture provided proximate a bottom of the canister. At least one of the first and second apertures may open to the interior. At least one of the apertures may be configured to be connected to a breather hose, and one or more output apertures may be formed in the canister to release gases received through the breather hose. An exterior of the canister may be shaped to resemble an ignition system coil.

In various embodiments, the one or more output apertures may be formed in a sidewall of the canister. The crankcase breather may further comprise a removable cap portion at the top of the canister portion. The first aperture may be formed on a projecting portion of the removable cap portion, and the projecting portion may be configured to appear as an output terminal portion of an ignition system coil. The cap portion may be configured to screw onto the canister portion. The cap portion may be configured to be connectable to the canister portion by a friction fit. The crankcase breather may further comprise two posts extending upward from proximate the top of the canister portion. The cap portion may include two receiving holes configured to receive the respective posts to fix the cap portion to the canister portion. The two posts may be configured to appear as primary terminals of an ignition system coil.

In various embodiments, the crankcase breather may further comprise one or more partitions provided inside the canister portion, and they may be configured to inhibit liquids passed to the canister portion from splashing out of the output apertures. The first aperture may be formed on a removable cap, the removable cap defining a hyperbolic conical shape. The removable cap may define a perimetral edge defining a downwardly protruding lip. The perimetral edge and protruding lip may be shaped to correspond to, overlie, and mate with an upper circular edge of the canister. The removable cap may further define a central projection that extends from the perimetral edge opposite the canister. The first aperture may be centrally located on the central projection.

In various embodiments, the second aperture may be formed on a lower surface of the canister. The second aperture may be centrally located on the lower surface of the canister. The second aperture may be sized to receive a breather hose.

According to various example embodiments of the present general inventive concept, faux ignition coil crankcase breather may be provided to function as a crankcase breather and catch can while presenting the look of an ignition coil of a distributor ignition system.

Additional aspects and advantages of the present general inventive concept will be set forth in part in the description which follows, and, in part, will be obvious from the description, or may be learned by practice of the present general inventive concept. Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modifications, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a crankcase breather is formed to have the appearance of an ignition system coil that would be included in a carburetor- and distributor-based ignition system. The crankcase breather, sometimes referred to herein as a "faux" or "simulated" ignition coil crankcase breather, or simply a "breather", is provided to be a part of a crankcase ventilation system, and to allow ventilation of gases from a crankcase ventilation tube while collecting liquids therein. The crankcase breather operates as a "catch can" for the ventilation system.

Figure 1:
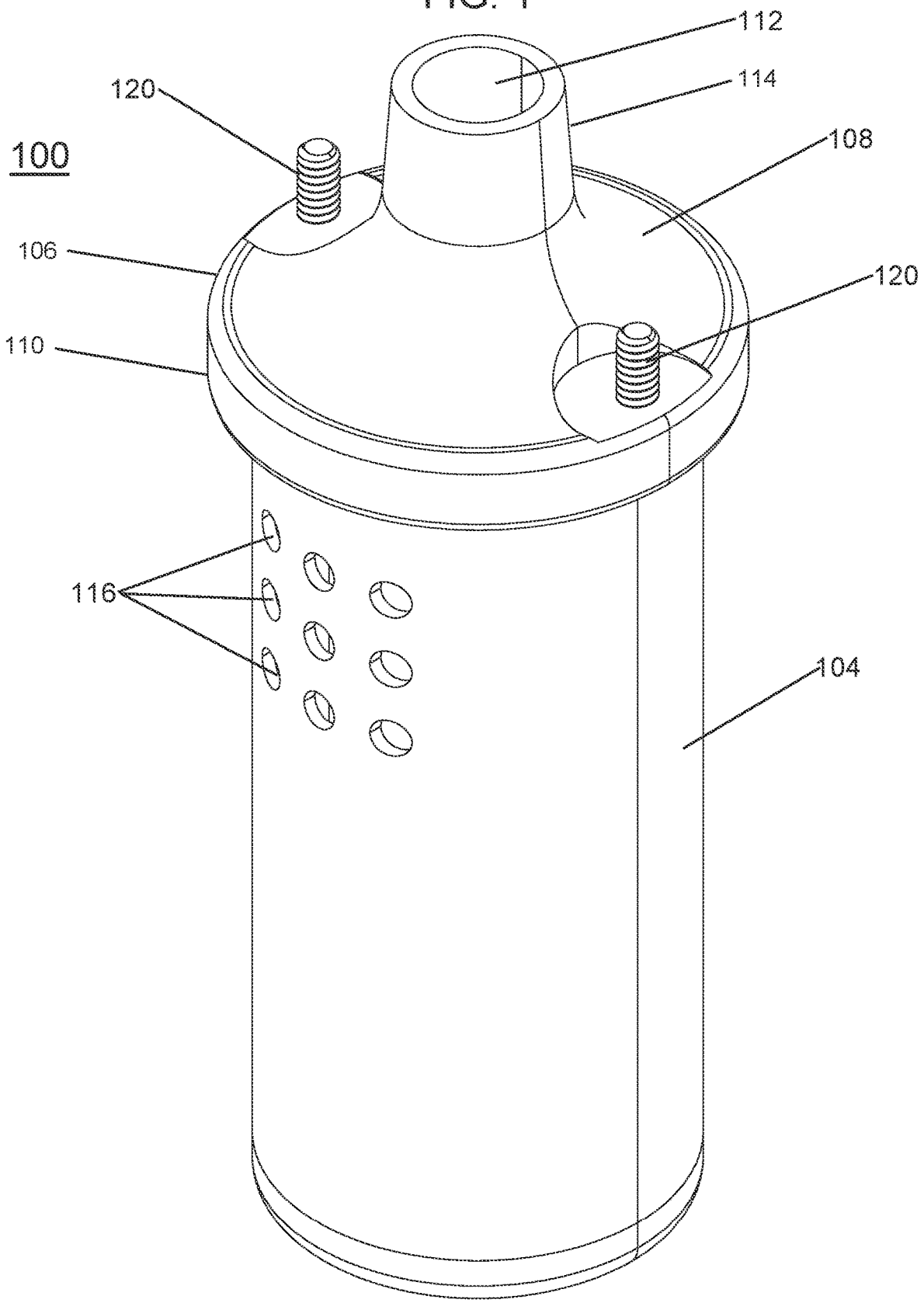
FIG. 1 illustrates a perspective view showing upper and rear surfaces of a faux ignition coil crankcase breather according to an example embodiment of the present general inventive concept.
Figure 2:
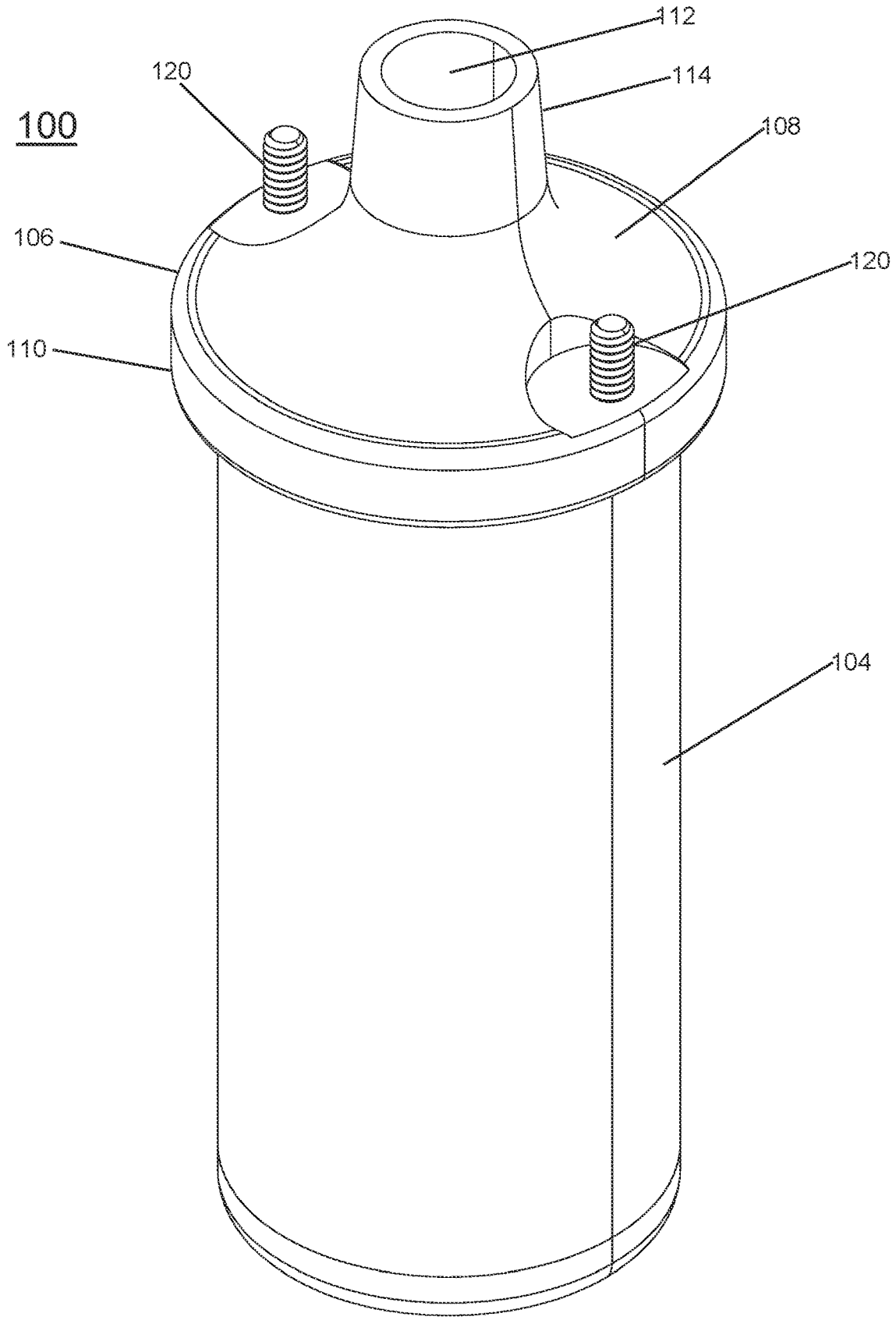
FIG. 2 illustrates a perspective view showing upper and front surfaces of the faux ignition coil crankcase breather of FIG. 1.
Figure 3:
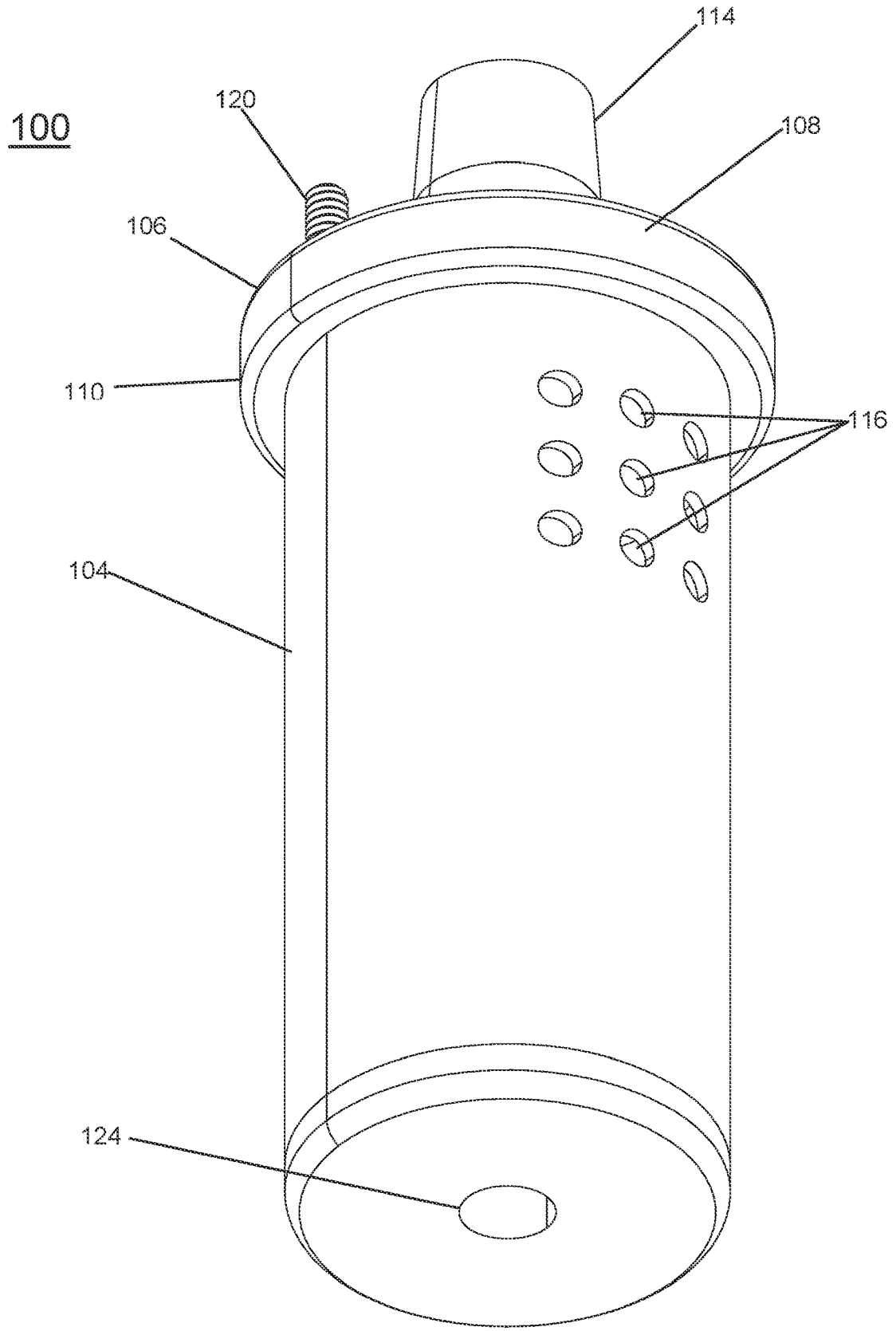
FIG. 3 illustrates a perspective view showing lower and rear surfaces of the faux ignition coil crankcase breather of FIG. 1.
Figure 4:
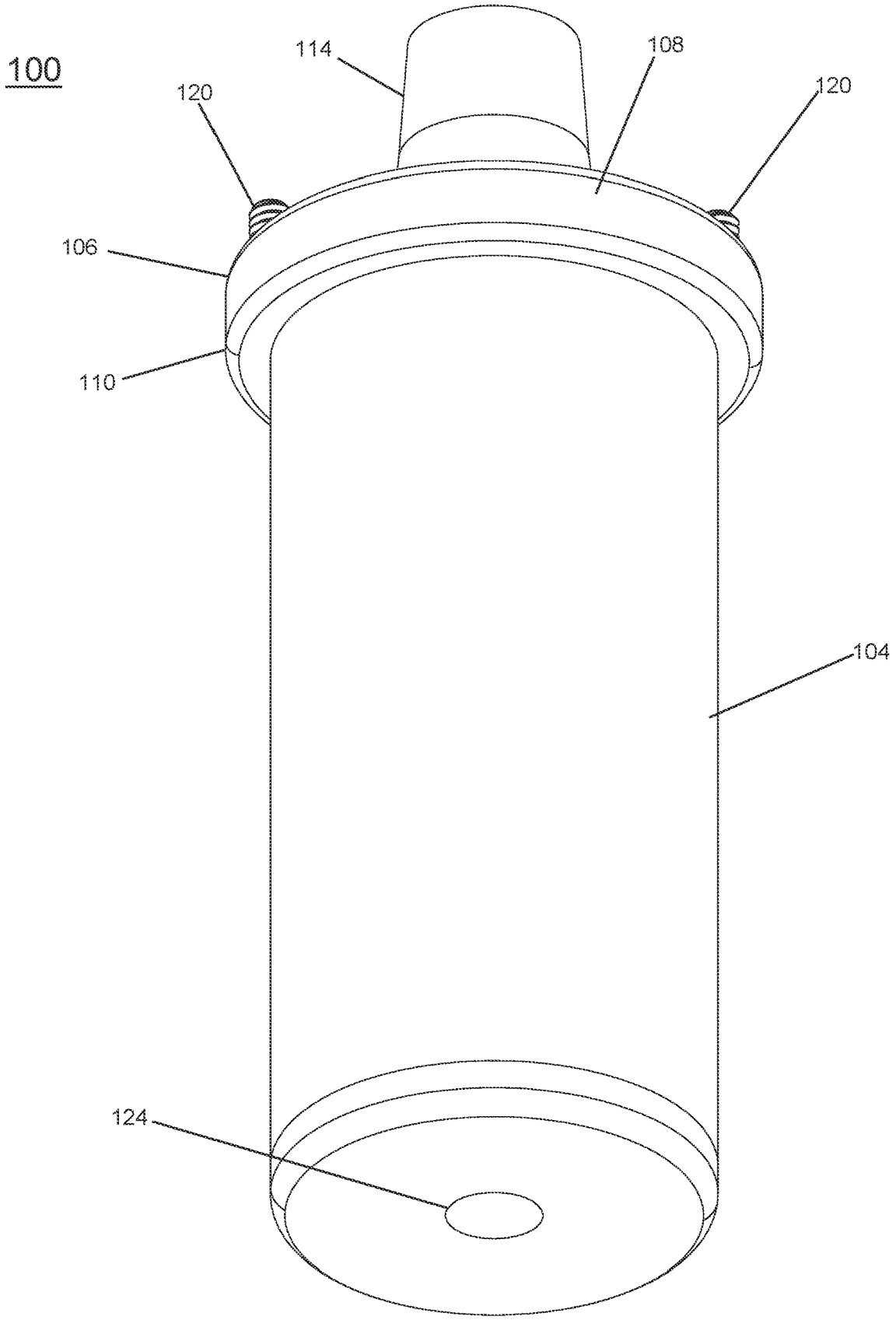
FIG. 4 illustrates a perspective view showing lower and front surfaces of the faux ignition coil crankcase breather of FIG. 1.

FIGS. 1-4 illustrate various perspective views of a faux ignition coil crankcase breather according to an example embodiment of the present general inventive concept. As shown in FIGS. 1-4, the crankcase breather 100 is formed to have the appearance of an ignition system coil. The crankcase breather 100 includes a substantially cylindrical canister portion 104 having an upper cap 108. The upper cap 108 defines a generally hyperbolic conical shape, having a relatively wide perimetral edge 106 defining a downwardly protruding lip 110 shaped to correspond to, overlie, and mate with an upper circular edge of the canister portion 104, and a central projection 114 that extends upwardly from the perimetral edge 106 and the canister portion 104. The central projection 114 of the upper cap 108 defines a centrally located, upward-facing upper aperture 112 which, in certain embodiments, may be sized to receive a breather hose (not shown) of a crankcase ventilation system, an ignition wire of an ignition coil system, or the like. A lower portion of the canister portion 104 defines a lower aperture 124 which, likewise, may be sized to receive a breather hose (not shown) of a crankcase ventilation system, an ignition wire of an ignition coil system, or the like. Thus, in various embodiments, a breather hose may be routed to an interior of the canister portion 104 via one or more of the upper or lower apertures 112, 124. Thus, in one of these configurations, emissions received through the breather hose of the crankcase ventilation system are collected in the canister portion 104.

In this example embodiment, the central projection 114 of the cap 108 is configured to look like the output terminal on a conventional ignition system coil. The upper aperture 112 is configured to receive a faux ignition cable of an ignition coil system, which may be provided for purely aesthetic purposes. The lower aperture 124 is configured such that a breather hose may be fitted thereto to deliver emissions from the crankcase breather system. In this configuration, the faux ignition cable may look like a high voltage coil cable that would connect an ignition system coil to a distributor of a distributor ignition system, and the breather hose of a vehicle engine may be inconspicuously received through the lower aperture 124 of the crankcase breather 100, thereby allowing the crankcase breather 100 to function as a "catch cup" style breather for the breather hose, while also simultaneously disguising the breather to an observer of the vehicle engine and providing the illusion that the engine includes an ignition system coil. In various embodiments, the crankcase breather 100 can be combined with other faux carburetor-based fuel system components, such as for example, a simulated distributor. In such embodiments, the breather hose could be run from the intake aperture 112 of the crankcase breather 100, through a top opening of the faux distributor, through the bottom of the faux distributor, and to the engine block, thereby disguising the breather hose as an ignition system coil wire of an older type carburetor-based fuel system.

A plurality of output apertures 116 are formed in a sidewall of the canister portion 104 to allow gases passed into the crankcase breather through the intake aperture 112 to leave the canister portion 104. While various quantities and configurations of output apertures may be provided in different example embodiments without departing from the scope of the present general inventive concept, in the example embodiment illustrated in these figures, the output apertures 116 are formed on one side, and near the top, of the canister portion 104. With such a configuration, the output apertures 116 are located far enough up the canister portion 104 that liquids can collect near the bottom of the canister portion 104, and gases can escape the output apertures 116 without much of the liquids also escaping therethrough. Also, the crankcase breather 100 can be mounted, for example by a bracket attached to the firewall, such that the output apertures 116 face away from directions by which the crankcase breather 100 may be typically viewed, so as not to upset the illusion of a conventional ignition system coil. Some of these described features assume the mounting of the crankcase breather 100 with the illustrated intake aperture being oriented to face upward. Various example embodiments of the present general inventive concept may be configured for different mounting orientations, and thus may have output apertures 116 located near the other end of the canister portion 104, and so on.

In various example embodiments, one or more of the upper or lower apertures may be closed, and other apertures may be formed at other locations around the crankcase breather to allow for routing of the crankcase breather hose to the interior of the canister portion. For example, in various embodiments, a breather hose intake aperture may be formed at a bottom end of the crankcase breather, with the simulated output terminal being either closed or attached to a simulated ignition cable that has only aesthetic function. In various embodiments, a breather hose intake aperture may be formed by the upper aperture at a upper end of the simulated output terminal, with the lower end of the canister portion 104 being closed. Additionally, in various example embodiments, the crankcase breather 100 may be provided with partitions, baffles, or the like that partially block portions of the interior of the canister portion 104 to help prevent liquids collected therein from splashing upwards and out of the output apertures, but allow the liquids to flow downward toward the bottom of the canister portion 104. Thus, rather than housing primary and secondary windings, an iron core, and other such elements found in an ignition system coil, the crankcase breather 100 of the present general inventive concept acts as a catch can and breather for the crankcase breather system.

In the illustrated embodiment, the output apertures 116 are configured to vent the canister portion 104 to the atmosphere. In other embodiments, one or more conduits (not shown) may be provided to route gasses leaving the canister portion to an air intake of the engine. In this regard, it will be recognized that numerous variations may of output apertures may be provided to accomplish one or both of these functions without departing from the spirit and scope of the present general inventive concept.

In various example embodiments of the present general inventive concept, the cap portion 108 may be configured to be either integrally formed with, fixed to, secured to, or removable from the canister portion 104. The cap portion 108 may be configured so as to be threaded onto the canister portion 104, or to have a friction fit with the canister portion 104, and so on, such that the cap portion 108 may be removed to conveniently empty the contents of the breather or catch can. The crankcase breather 100 may be provided with a pair of posts 120 extending upward from a top of the breather 100, the posts 120 being configured to look like the primary terminals of a conventional ignition system coil. In various example embodiments, the posts 120 may be cosmetic, to allow faux primary terminal connections to be made if the user wishes. In various example embodiments the posts 120 may be configured as a means by which to attach the cap portion 108 to the canister portion 104, with a securing nut that may be hidden beneath faux terminal connections.

Various example embodiments of the present general inventive concept may provide a simulated ignition system coil including a canister portion, an intake aperture provided proximate a top of the canister portion, the intake aperture configured to be connected to a breather hose, and one or more output apertures formed in the canister to release gases received through the breather hose. The one or more output apertures may be formed in a sidewall of the canister portion. The simulated ignition system coil may further include a removable cap portion at the top of the canister portion. The intake aperture may be formed on a projecting portion of the removable cap portion, the projecting portion being configured to appear as an output terminal portion of an ignition system coil. The cap portion may be configured to screw onto the canister portion. The cap portion may be configured to be connectable to the canister portion by a friction fit. The simulated ignition system coil may further include two posts extending upward from proximate the top of the canister portion, wherein the cap portion includes two receiving holes configured to receive the respective posts to fix the cap portion to the canister portion. The two posts may be configured to appear as primary terminals of an ignition system coil. The simulated ignition system coil may further include one or more partitions provided inside the canister portion, and configured to inhibit liquids passed to the canister portion from splashing out of the output apertures.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A crankcase breather comprising:

a cylindrical canister having a hollow interior, a circular bottom wall defining a central lower aperture sized to receive a breather hose, a curved side wall, and an open upper end along an upper edge of the side wall;

a cap having an annular edge wall configured to encircle the upper edge of the side wall and restrict air flow through the upper end of the canister, the cap defining a central upper aperture defining a central upper limit of the cap and an upwardly-tapered hyperbolic conical shape extending from the edge wall to the upper aperture; and a plurality of output apertures formed in the side wall of the canister to release gases received through the breather hose;

whereby the upwardly-tapered hyperbolic conical shape of the cap functions to restrict, but not prevent, the flow of gasses from within the canister outward through the upper aperture, thereby urging gasses within the canister outward therefrom through the output apertures.

2. The crankcase breather of claim 1, wherein the cap is configured to screw onto the canister.

3. The crankcase breather of claim 1, wherein the cap is configured to be connectable to the canister by a friction fit.

4. The crankcase breather of claim 1, the canister further comprising two posts, each post extending upward from an opposite respective side of the upper edge of the side wall, wherein the cap includes two receiving holes proximate an intersection of the edge wall with the upwardly-tapered hyperbolic conical shape configured to receive the respective posts to fix the cap to the canister.

5. The crankcase breather of claim 4, the cap defining a pair of flat surfaces, each flat surface encircling a respective one of the receiving holes and extending perpendicular to the edge wall.

6. The crankcase breather of claim 1, wherein the plurality of output apertures comprises nine apertures arranged in an array proximate an upper end of the side wall.

* * * * *